US007650929B2

(12) United States Patent
Huang

(10) Patent No.: US 7,650,929 B2
(45) Date of Patent: Jan. 26, 2010

(54) COOLER MODULE

(76) Inventor: Tsung-Hsien Huang, No. 18-28, Ta Hu Rd., Hu Pei Village, Yuan Shan Hsiang, I-Lan Hsien (TW)

( * ) Notice: Subject to any disclaimer, the term of this patent is extended or adjusted under 35 U.S.C. 154(b) by 201 days.

(21) Appl. No.: 11/865,041

(22) Filed: Sep. 30, 2007

(65) Prior Publication Data

US 2009/0084529 A1 Apr. 2, 2009

(51) Int. Cl.
*H05K 7/20* (2006.01)

(52) U.S. Cl. ..... 165/80.3; 165/104.33; 361/700

(58) Field of Classification Search ..... 165/80.3, 165/104.33; 361/700
See application file for complete search history.

(56) References Cited

U.S. PATENT DOCUMENTS

2006/0104032 A1* 5/2006 Lee et al. ..... 361/700
2006/0255453 A1* 11/2006 Wu ..... 257/720
2007/0215327 A1* 9/2007 Lai et al. ..... 165/104.33
2007/0217162 A1* 9/2007 Zhou et al. ..... 361/710
2008/0055854 A1* 3/2008 Zhou et al. ..... 361/700
2008/0169089 A1* 7/2008 Wu et al. ..... 165/104.33
2008/0216990 A1* 9/2008 Min et al. ..... 165/80.3
2008/0314555 A1* 12/2008 Wu et al. ..... 165/80.3

* cited by examiner

*Primary Examiner*—Allen J Flanigan
(74) *Attorney, Agent, or Firm*—Pai Patent & Trademark Law Firm; Chao-Chang David Pai

(57) ABSTRACT

A horizontal cooler module includes a heat sink formed of a stack of radiation fins, a base block tightly fitted into the bottom side of the heat sink, and heat pipes each having a first extension arm respectively tightly inserted through the radiation fins and a second extension arm respectively fitted into the bottom open grooves of the base block with a respective flat wall portion of the second extension arm exposed to the outside of the base block and kept in flush with the bottom wall of the base block for direct contact with an external electronic chip to transfer heat energy from the electronic chip to the heat sink for quick dissipation.

2 Claims, 3 Drawing Sheets

COOLER MODULE

BACKGROUND OF THE INVENTION (a) Field of the Invention

The present invention relates to a cooler module for cooling an electronic chip and more particularly to a horizontal cooler module, which has the parts tightly fitted to one another with a flat wall portion of the heat pipes thereof exposed to the outside of the base block for direct contact with the heat source for quick dissipation of heat energy from the heat source.

(b) Description of the Prior Art

Heat pipes are intensively used in cooler modules for cooling semiconductor chips or the like. In addition to heat pipes, a regular cooler module further comprises a heat sink formed of a stack of radiation fins, and a base block. The radiation fins are extruded from aluminum or copper. The heat pipes are enclosed metal tubes filled with a working fluid. The base block is an aluminum or copper block. Because the heat pipes and base block of this design of cooler module are made of different materials, a nickel plating technique is necessary so that the heat pipes and the base block can be bonded together by applying a tin solder or thermal glue. This cooler module fabrication and assembly procedure is complicated, resulting in low yield rate and high manufacturing cost. Soldering between the base block and the heat pipes relatively lowers the heat transfer efficiency of the cooler module. Further, soldering the heat pipes to the base block may cause an environmental pollution.

When in use, the base block (aluminum base block or copper base block) is disposed in contact with the hot side of the electronic chip to absorb heat energy from the electronic chip and to transfer absorbed heat energy to the heat pipes and then the heat sink for further dissipation. Because heat energy is indirectly transferred to the heat pipes and the heat sink, the heat dissipation efficiency of this design of cooler module is low.

SUMMARY OF THE INVENTION

The present invention has been accomplished under the circumstances in view. According to one aspect of the present invention, the horizontal cooler module comprises a plurality of radiation fins, a plurality of heat pipes, and a base block. The component parts of the cooler module are tightly fitted together. The heat pipes each have a flat wall portion exposed to the outside of the base block for direct contact with the electronic chip to directly transfer heat energy from the electronic chip to the heat sink for quick dissipation.

According to another aspect of the present invention, the connection of the component parts of the cooler module is enhanced as a result of thermal expansion, providing excellent heat conductivity and achieving excellent heat dissipating performance. Because the horizontal cooler module eliminates tin soldering or nickel plating, the fabrication of the present invention does not cause any environmental pollution due to tin soldering or nickel plating. Therefore, fabrication of the present invention is more in conformity with environmental protection than fabrication of conventional cooler modules.

According to still another aspect of the present invention, the base block has a plurality of bottom open grooves, which receive the heat pipes respectively, and a plurality of clamping ribs protruded from the bottom wall and extending along two opposite sides of each of the bottom open grooves. After the heat pipes are inserted into the bottom open grooves of the base block, the clamping ribs can be transversely compressed to clamp the heat pipes, holding the heat pipes firmly in the associating bottom open grooves.

DETAILED DESCRIPTION OF THE PREFERRED EMBODIMENTS

Figure 1:
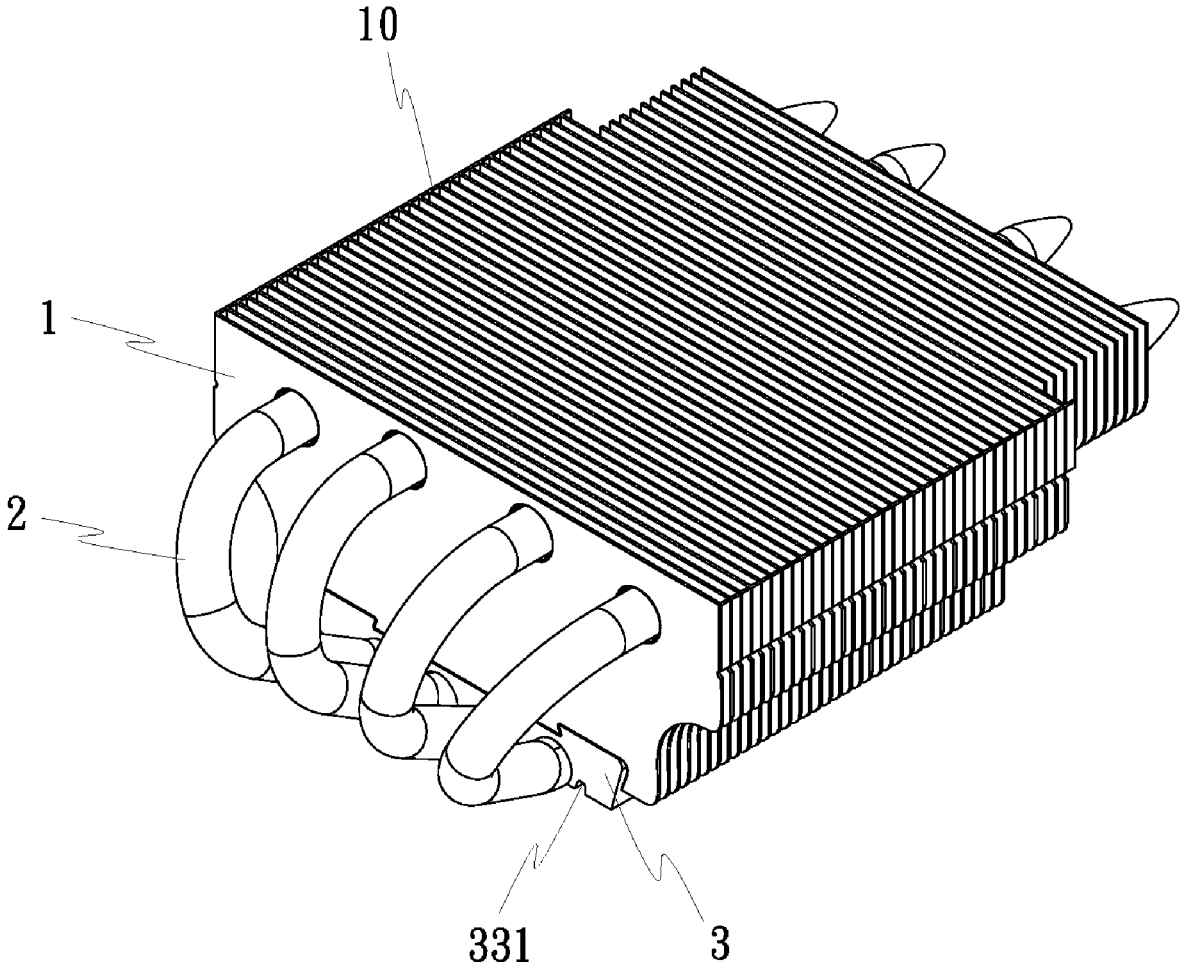
FIG. 1 is an oblique top view of a horizontal cooler module in accordance with the present invention.
Figure 2:
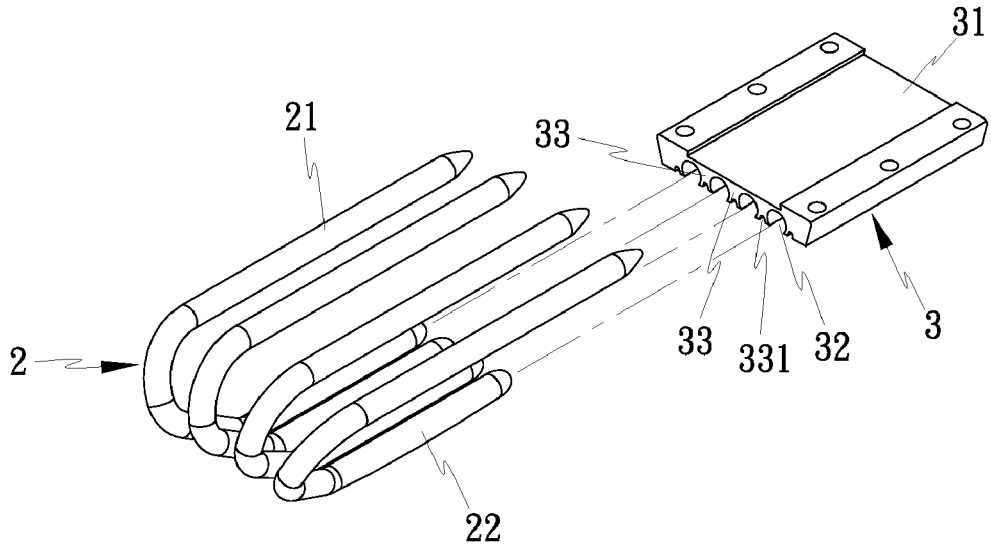
FIG. 2 is an exploded view of the heat pipes and the base block for the horizontal cooler module in accordance with the present invention.
Figure 3:
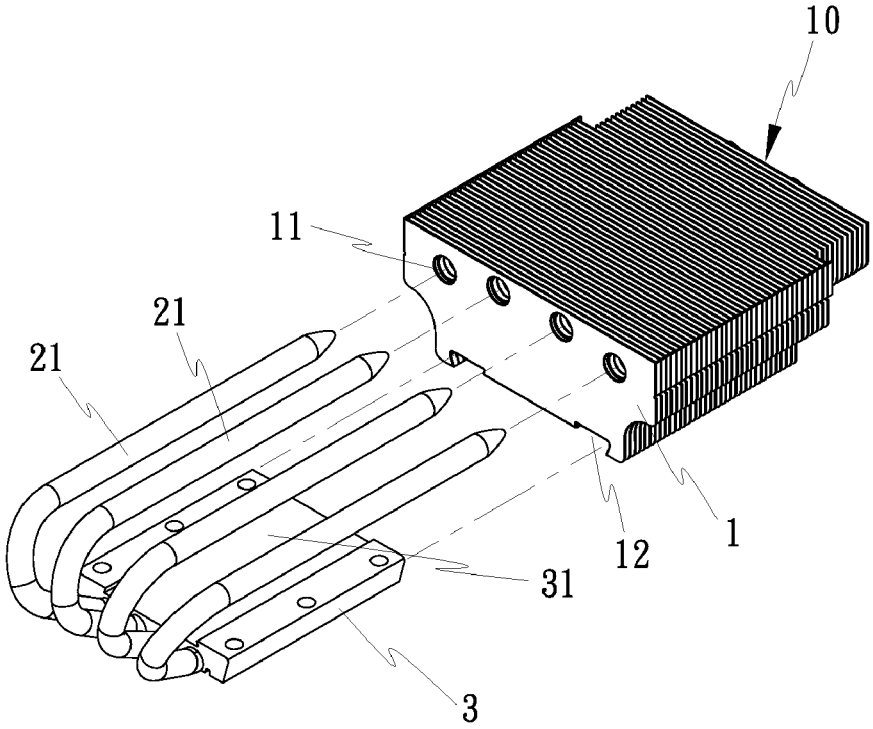
FIG. 3 is an exploded view of the horizontal cooler module in accordance with the present invention.

Referring to FIGS. 1~3, a horizontal cooler module in accordance with the present invention is shown as comprising a plurality of radiation fins 1, a plurality of heat pipes 2, and a base block 3.

The radiation fins 1 are stacked together, forming a heat sink 10. Each radiation fin 1 has a plurality of through holes 11 for receiving the heat pipes 2 in a tight manner, and a bottom notch 12 of a predetermined profile for matching the upper part of the base block 3.

Figure 4:
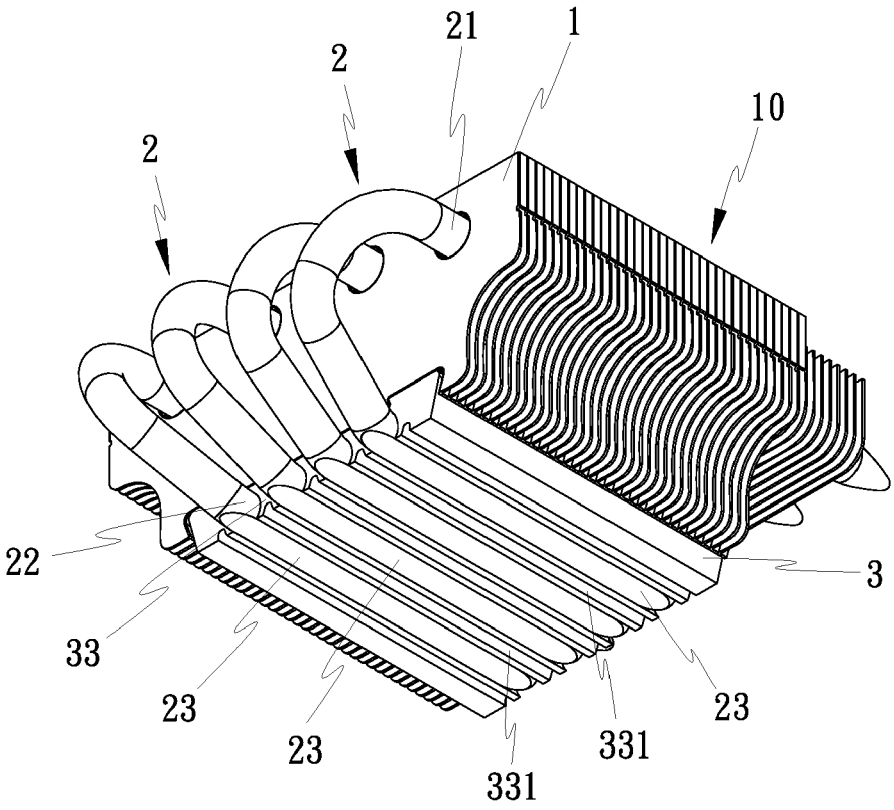
FIG. 4 is an oblique bottom view of the horizontal cooler module in accordance with the present invention.

The heat pipes 2 are enclosed, I-shaped or U-shaped pipes filled with a working fluid, each having a first extension arm 21 at one end, a second extension arm 22 at the other end, and a flat wall portion 21 formed on the bottom side of the second extension arm 22 (see FIG. 4). After the heat pipes 2 are fastened to the bottom side of the base block 3, the flat wall portions 21 of the second extension arms 22 are exposed to the outside of the bottom wall of the base block 3 and kept in flush with the bottom surface of the base block 3.

The base block 3 is a solid metal (copper or aluminum) block, having a top wall 31 that fits the bottom wall of the heat sink 10, a plurality of bottom open grooves 32, which receive the heat pipes 2 respectively, a plurality of clamping ribs 33 respectively longitudinally extending along two opposite sides of each of the bottom open grooves 32 for securing the heat pipes 2 to the bottom open grooves 32.

The aforesaid radiation fins 1, heat pipes 2, and base block 3 are tightly fastened together. Due to heat expansion of the heat pipes 2, the parts of the horizontal cooler module fit one another tightly. After installation of the horizontal cooler module, the flat wall portions 23 of the second extension arms 22 of the heat pipes 2 are exposed to the outside of the base block 3 in a flush manner and closely disposed in contact with the heat source, for example, electronic chip, to transfer heat energy from the electronic chip to the heat sink 10 for quick dissipation. Because the heat pipes 2 directly transfer heat energy from the electronic chip to the heat sink 10 for quick dissipation, the heat dissipating efficiency of the present invention is high.

Because the parts of the cooler module fit one another tightly, the parts are firmly secured together without vibration, and the fabrication of the cooler module is easy and rapid, thus lowering the cost. Because the flat wall portions 23 of the heat pipes 2 are kept in direct contact with the heat source, the horizontal cooler module dissipates heat efficiently. Therefore, the horizontal cooler module provides excellent thermal conductivity and achieves excellent heat dissipating performance. Further, because the invention eliminates tin soldering, the fabrication of the cooler module does not cause environmental pollution due to tin soldering, i.e., the invention is more in conformity with environmental protection.

Figure 5:
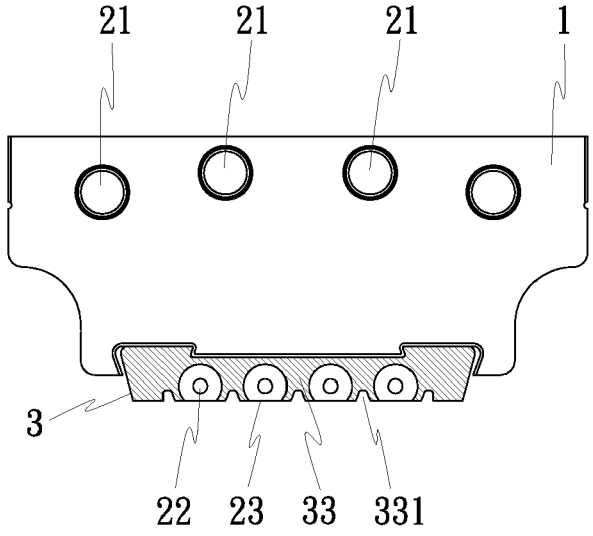
FIG. 5 is a sectional view of the horizontal cooler module in accordance with the present invention.

The clamping ribs 33 of the base block 3 are respectively disposed at two sides of each of the bottom open grooves 32, each having a longitudinal cut 331 that have a V-shaped cross section (see FIG. 4). By means of the longitudinal cuts 331, the clamping ribs 33 are transversely compressible. When setting the heat pipes 2 into the respective bottom open grooves 32, the clamping ribs 33 are transversely compressed and clamped on the associated heat pipes 2 (see FIGS. 4 and 5).

A prototype of the horizontal cooler module has been constructed with the features of FIGS. 1~5. The cooler module functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A horizontal cooler module, comprising a heat sink formed of a stack of radiation fins, a base block attached to said heat sink, and a plurality of heat pipes filled up with a working fluid and tightly inserted through the radiation fins of said heat sink and closely attached to said base block, wherein:

said base block is a metal block, having a top wall fitting one side of said heat sink, a plurality of bottom open grooves formed on a bottom wall thereof, and a plurality of clamping ribs each extending along two opposite sides of two said bottom open grooves and each having a longitudinal cut with a V-shaped cross section;

said heat pipes each have a first extension arm respectively fastened to each of the radiation fins of said heat sink and a second extension arm respectively and tightly fitted into said bottom open grooves of said base block, said second extension arm having a flat wall portion exposed to the outside of said base block and kept in flush with the bottom wall of said base block for direct contact with a heat source to transfer heat energy from the heat source to said heat sink for dissipation.

2. The horizontal cooler module as claimed in claim 1, wherein said base block is made out of copper or aluminum.

* * * * *